United States Patent [19]

Chadwick

[11] Patent Number: 4,819,528

[45] Date of Patent: Apr. 11, 1989

[54] RIBBON CUTTING APPARATUS HAVING MULTIPLE, INDEPENDENTLY DRIVEN GROUPS OF CUTTING BLADES

[75] Inventor: Arthur Chadwick, Mt. Vernon, N.Y.

[73] Assignee: Essex Manufacturing Company, New York, N.Y.

[21] Appl. No.: 128,334

[22] Filed: Dec. 3, 1987

[51] Int. Cl.[4] ..... B26D 1/03; B26H 7/14

[52] U.S. Cl. ..... 83/13; 83/365; 83/367; 83/368; 83/425.4; 83/505; 83/508.3; 226/20; 242/57.1

[58] Field of Search ..... 83/18, 39, 425.3, 425.4, 83/506, 508.3, 367, 175, 176, 368, 365, 13, 505; 226/20, 88; 242/72 B, 56.2, 57.1, 67.3 F

[56] References Cited

U.S. PATENT DOCUMENTS

| | | | |
|---|---|---|---|
| 294,970 | 3/1884 | Coupland . | |
| 588,844 | 8/1897 | Volz . | |
| 868,688 | 10/1907 | Naylor et al. . | |
| 1,002,883 | 9/1911 | Tower | 83/508.3 |
| 1,130,909 | 3/1915 | Kremer | 83/506 X |
| 1,148,146 | 7/1915 | Cameron et al. | 83/506 X |
| 1,792,460 | 2/1931 | Davis . | |
| 1,809,619 | 6/1931 | Brown . | |
| 1,835,556 | 12/1931 | Brown . | |
| 2,360,653 | 10/1944 | Davidson | 83/506 |
| 2,533,996 | 10/1950 | Clarkson | 164/65 |
| 2,796,933 | 6/1957 | Gelleke | 83/506 |
| 3,177,751 | 4/1965 | Vercauteren | 83/367 X |
| 3,407,690 | 10/1968 | Stanley | 83/47 |
| 3,417,645 | 12/1968 | Brock | 242/57.1 X |
| 3,489,184 | 1/1970 | Bernath | 139/291 |
| 3,627,301 | 12/1971 | Bensen et al. | 242/57.1 X |
| 3,699,621 | 10/1972 | Clarke et al. | 29/113 R |
| 3,877,199 | 4/1975 | Gierse et al. | 26/9 |
| 4,135,677 | 1/1979 | Warczak | 242/72 B |
| 4,137,614 | 2/1979 | Wolstencroft | 242/56.2 X |
| 4,312,255 | 1/1982 | Holmstrom | 83/582 |
| 4,649,782 | 3/1987 | Cavagna | 83/425.4 |
| 4,674,380 | 6/1987 | Hecht et al. | 83/425.2 |

*Primary Examiner*—Frank T. Yost
*Assistant Examiner*—Rinaldi Rada
*Attorney, Agent, or Firm*—Richard C. Woodbridge

[57] ABSTRACT

A ribbon cutting apparatus which solves the problems of lateral shifting, stretching and shrinking of a printed web of material by providing a plurality of blade carrying blocks each of which may be independently positioned with respect to a travelling web. Each blade carrying block supports between 2 and 9 circular blades. Each of the blades in turn is connected to a small pneumatic cylinder which presses the blades against a platen roller so as to crush cut the web of material passing through. An electric eye detects the location of a registration line that is located substantially near the center of the web. The blade carrying blocks are normally located symmetrically on opposite sides of the registration line. If the web is out of registration the take-off roll is driven horizontally to compensate for the mis-positioning. Each of the blade carrying blocks is independently positionable by a manual adjustment mechanism, such as a wheel connected through a gearing mechanism to each blade carrying blocks. Accordingly, a machine operator is capable of rapidly making fine adjustments to the alignment of the groups of blades on either side of the registration line of the web as the web travels through the machine.

15 Claims, 5 Drawing Sheets

RIBBON CUTTING APPARATUS HAVING MULTIPLE, INDEPENDENTLY DRIVEN GROUPS OF CUTTING BLADES

BACKGROUND OF THE INVENTION

1. Field of the Invention

The invention relates to a machine for cutting ribbons from a traveling web of material.

2. Description of the Related Art

There are a number of devices presently known for cutting ribbons from a web of fabric material. However, none of these references satisfactorily solve the problems associated with cutting ribbons with printed patterns from the moving web. When a web of fabric material is printed with several patterns and rolled onto a roller, the web has a tendency to shrink in some spots, stretch in others and shift laterally along the roller. Accordingly, when the web is unrolled, it becomes impossible to align the cutter blades with each of the patterns and cut ribbons without cutting off parts of the printed patterns.

If the web only contains solid colors or random patterns, misalignment of the cutter blades with the patterns on the web due to stretching, shrinking or lateral shifting does not produce visible variations in the cut ribbons. If the printed patterns, however, are not random, then misalignment of the cutter blades with the printed patterns due to stretching, shrinking or shifting of the web results in very noticeable variations in the cut ribbons. Some prior ribbon cutting devices disclosed the use of only one adjustable blade for trimming the salvage, for example, U.S. Pat Nos. 1,792,460; 1,809,619 and 1,835,556 all disclose a single adjustable position blade for use in splitting cloth as it comes off a loom.

Some references disclosed devices which moved all of the cutter blades, as a unit, in order to follow variations in the web. These include: U.S. Pat. No. 868,688 which describes an early device employing a mechanism for moving all of the cutting knives on a loom as a single unit; U.S. Pat. No. 588,844 which discloses another device employing a plurality of rotary knives all carried on the same shaft for cutting strips of bandage material off a wider bolt of fabric; and, U.S. Pat. No. 294,970 which discloses another machine for cutting strips of fabric from material in which a plurality of independently mounted blades are employed for that purpose.

The most recent reference which uses this approach, i.e., moving all of the cutter blades as a unit, is U.S. Pat. No. 4,674,380 which describes an apparatus for cutting ribbons using a plurality of razor blades. In this reference, all of the razor blades are driven as a single unit by a lateral shifting means which includes a flexible and resilient rod interconnecting each of the blade holding means adjacent to the associated razor blade. U.S. Pat. 4,674,380, however, does not discuss or suggest several independent groups of blades which are separately driveable. Also cited in the prosecution of U.S. Pat. No. 4,674,380 are U.S. Pat. Nos. 3,407,690; 3,699,621; 3,877,199 and 4,312,255. Of that group, U.S. Pat. Nos. 3,877,199 and 4,312,255 are of possible relevance in that they disclose means for adjusting individual cutting blades on a machine that has a continuously moving web.

All of the foregoing references, however, suffer from the same drawback, in that all cutter blades adjust as a group to variations in the web. These references thus only solve the problem of lateral shifting of the web. None of the devices disclosed in these references, however, are able to compensate for the frequent stretching and shrinking of the web, resulting in one printed pattern being displaced to some degree in one direction while other printed patterns are simultaneously being displaced to some other degree in other directions. Solving this problem requires the separate adjustment of individual groups of blades in one direction while other groups of blades remain the same or are adjusted to a greater or lessor extent in another direction.

SUMMARY OF THE INVENTION

Briefly described, this invention solves the problems of lateral shifting, stretching and shrinking of the printed web of material by providing a ribbon cutting apparatus which includes a plurality of blade carrying blocks, designed so that each of which may be independently positioned with respect to the travelling web. Each blade carrier supports between 2 and 9 circular blades each of which has a small pneumatic cylinder connected thereto for pressing it against a platen roller so as to crush cut the web of material passing therethrough. The web of material preferably includes a registration line near its center which is used as a guide during the cutting process. An electric eye mounted on the machine detects the location of the central registration line. If the web is out of registration the take-off roll is driven horizontally to compensate for the mis-positioning. A number of blade carrying blocks are positioned symmetrically on each side of the registration line. Each of the blade carrying blocks is independently positionable by a manual adjustment mechanism comprising a wheel connected through a series of gears to each blade carrying block. The machine operator is capable of rapidly making fine cutting adjustments to each group of blades on the blade carrying blocks as the web of material travels at relatively high rates of speed through the machine.

These and other features of the invention will be more fully understood by reference to the following drawings.

DETAILED DESCRIPTION OF THE PREFERRED EMBODIMENT

Figure 1:
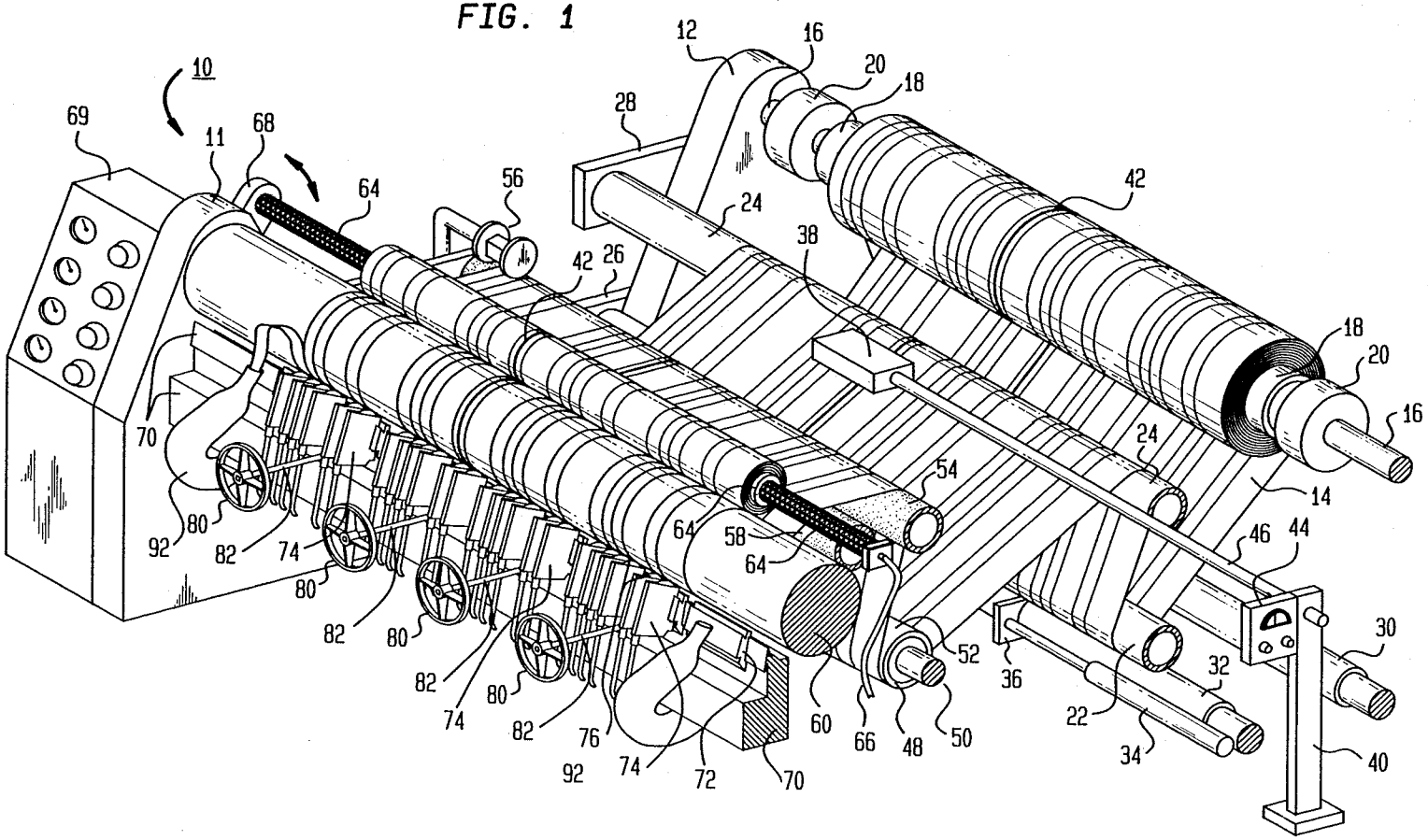
FIG. 1 is a partial cut-away view of the preferred cutting apparatus of this invention.
Figure 2:
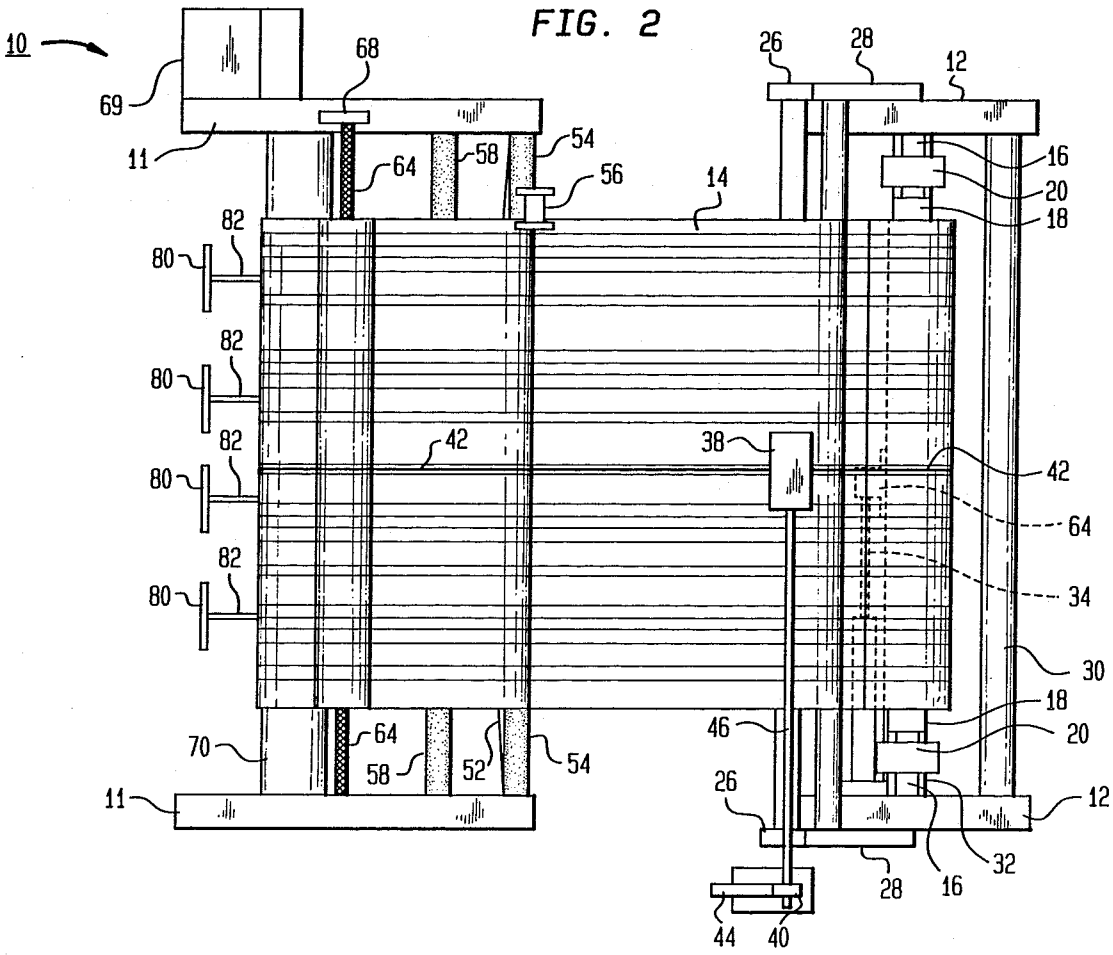
FIG. 2 is a top plan view of the apparatus illustrated in FIG. 1.
Figure 3:
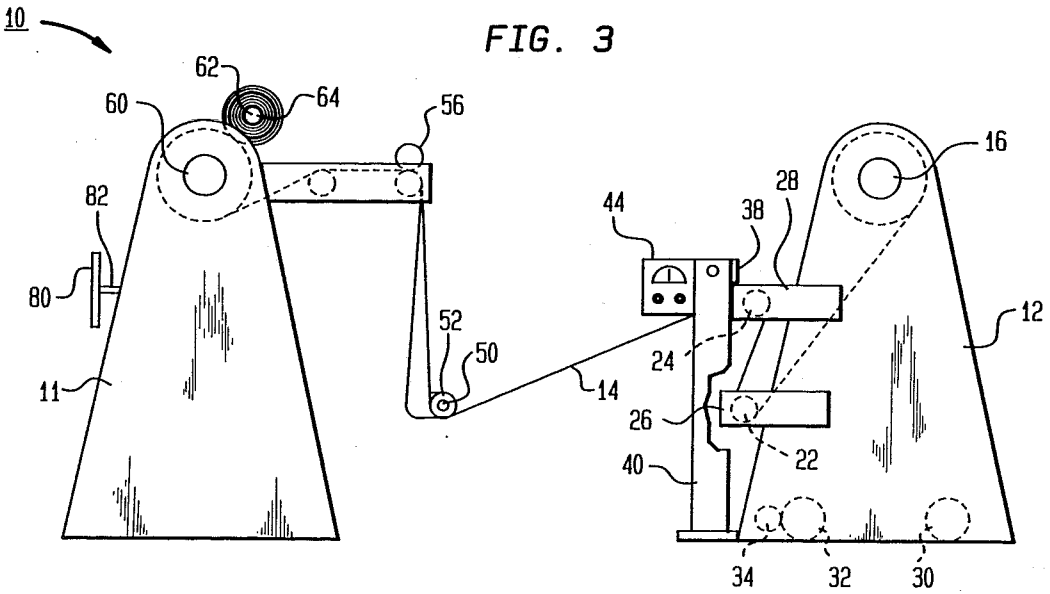
FIG. 3 is a side elevational view of the apparatus illustrated in FIG. 1.

Referring now to the drawings, FIG. 1 shows the preferred ribbon cutting apparatus 10 for cutting ribbon strips from a web of material 14. The apparatus 10 includes a horizontally displaceable backstand 12 upon which a rotatable metal take-off shaft 16 is mounted. The web of material 14 is originally rolled about a cardboard roll 18 which is placed on metal take-off shaft 16 and locked into place by two metal chucks 20. Take-off shaft 16 is controlled by a breaking mechanism (not shown) which maintains tension on the web of material 14 to stretch the web of material 14 as it is being unwound. Web of material 14 then passes, first, under and then, over two freely rotating aluminum rollers 22, 24, respectively, which further stretch out the web of material 14. Lower freely rotatable aluminum roller 22 is mounted to the horizontally displaceable backstand 11 by a lower support arm 26, and upper freely rotatable aluminum roller 24 is mounted to the horizontally displaceable backstand 11 by an upper support arm 28.

Horizontally displaceable backstand 12 can be moved to the left or to the right along the axis of rotation of take-off shaft 16. The displacement of the backstand is controlled by two servo-hydraulic cylinders 34 attached to said horizontally displaceable backstand 12 and to telescoping tracks 30, 32 by mounting bracket 36. An electric eye 38 is mounted to a stand 40 which is firmly fixed to the ground to hold electric eye 38 over the central portion of the web of material 14. A registration mark 42 printed in the central portion of the web of material 14 passes under electric eye 38. Control box 44 and the associated electronics, which are familiar to those skilled in the art but are outside the scope of this invention, control the servo-hydraulic cylinders 34 which move the backstand 12 horizontally on telescoping tracks 30, 32 in order to maintain the position of the registration mark directly under electric eye 38. Accordingly, if, for example, due to distortion of the web of material 14, the registration mark 42 is displaced to the left of electric eye 38 then the horizontally displaceable backstand 12 will be moved to the right in order to center the web of material 14 under the electric eye 38. Alternatively, if the registration mark is displaced to the right of electric eye 38, the horizontal displaceable backstand will be moved to the left in order to center the web of material 14 under electric eye 38. The electric eye 38 may be manually adjusted to the left or to the right by adjusting the position of bar 46 in stand 40 depending on the exact positioning of the web of material 14 on this apparatus 10, and the placement of the registration mark 42 on different webs of material 14.

The web of material 14 then passes under and around a spreader roller 48. Spreader roller 48 includes a bowed inner shaft 50 with its center bowed away from electric eye 38. A slidably rotatable rubber sleeve 52 is mounted on the bowed shaft 50 on sealed ball bearings which allow the rubber sleeve 52 to be rotated by the stretched web of material 14 passing under and past spreader roller 48. From the spreader roller 48 the web of material 14 passes over a freely rotatable sandpaper coated roller 54.

A freely rotatable counter wheel 56 is mounted over sandpaper roller 48 and the counter wheel is rotatably driven by the passage of the web of material 14 between counter wheel 56 and freely rotatable sandpaper coated roller 54. Counter wheel 56 records the length of the web of material 14 passing over sandpaper roller 48 and which subsequently is cut into ribbons. A number of additional freely rotating sandpaper rollers may be arranged on this apparatus to further stretch and align the web of material, depending upon the strength, flexibility and fiber composition of the web. It is preferred that at least two additional freely rotating sandpaper rollers are placed on the apparatus in order to allow the user flexibility in determining whether to further stabilize, flatten and stretch the web of material 14 on the additional rollers.

The web 14 passes from the freely rotatably sandpaper rollers across a driven sandpaper roller 39, and under and around a driven platen roller 60 upon which the web of material 14 is cut. Finally, after the web is cut and wound approximately 320° around the platen roller 60, the cut web of material 14 is wound in the opposite direction onto a cardboard core 62 which is mounted on a gnurled, expandable segmented shaft 64.

Gnurled, expandable segmented shaft 64 is rotatably driven in the opposite direction then platen roller 60, and is rotatably mounted on arm 68 which is displaceable in the direction of arrows, shown in FIG. 1, as the radius of the cut web of material 14 grows around cardboard core 62. The wound web of material 14 on cardboard core 62 which is mounted on gnurled, expandable segmented shaft 62 is in rotatory contact with the cut web of material 14 passing over platen roller 60. Contact between the fabric and cardboard core 62 and on platen roller 60, pushes pivot arm 68, displacing it upwards in the direction of the arrows. Displacement of gnurled, expandable segmented shaft 64 and arm 68 is assisted by an adjustable air cylinder mounted to arm 68.

A pressurized air hose 66 is connected to gnurled, expandable segmented shaft 64 and inflates a bladder in gnurled, expandable segmented shaft 64, causing the radial expansion of the shaft 64 to firmly hold the cardboard core 62. The finished, cut ribbons from the web of material 14 are taken off the gnurled, expandable segmented shaft 64 by releasing the air pressure in air hose 66 and sliding the cardboard roll 62 off shaft 64.

The apparatus downstream from spreader roller 48 to gnurled, expandable segmented shaft 64 are mounted on a frame 11 which houses the drive and control machinery for these rollers. Other controls, including those for the rate of rotation of the rollers are mounted in control box 69.

Preferably, the outside diameter of the platen roller 60 is approximately 6–8 inches. The outside diameter of sandpaper rollers 54, 58, the freely rotating rollers 22, 24 and spreader roller 48 are preferably about 3 to 5 inches. The cardboard core 62 preferably has an inside diameter of approximately 1 and ½ inches (200 wall).

Figure 4:
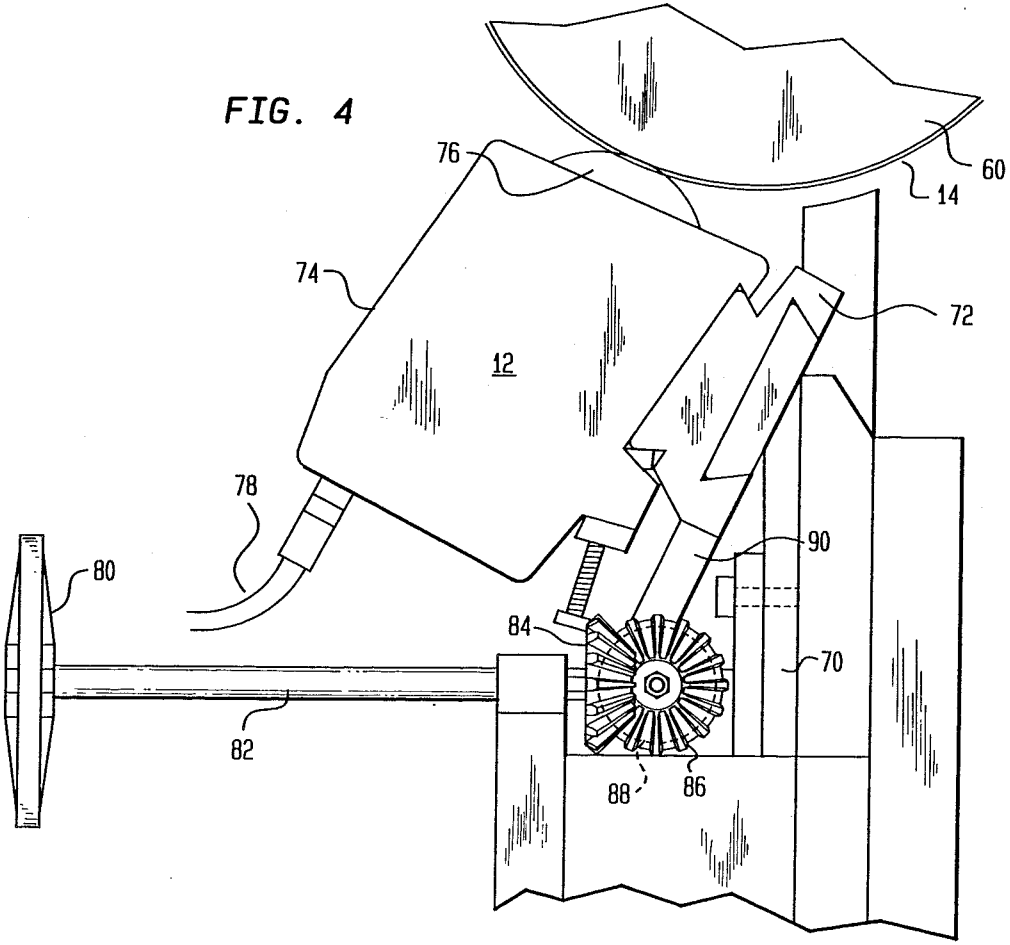
FIG. 4 is a detail side elevational, partial cutaway view of the preferred adjustment mechanism for the blade carrying blocks of this invention.

A horizontal metal track 70 is mounted on frame 11 parallel to the axis of rotation of platen roller 60. A plurality of blade carrying blocks 72 are slidably mounted on track 70. The blade carrying block 72 holds from two to nine blade housings 74 depending of the number of ribbons and the spacing of the patterns to be cut from the web of material 14. The track 70, blade carrying block 72 and a blade carrier 74 are shown in greater detail in FIGS. 4 and 5. Blade carrier 74 includes a rotatable circular blade 76 which is pushed upward, toward the platen roller 60 by an air pressure spring (not shown) driven by pressure from air hose 78. Circular blades 76 rotate freely against the forced rotation of platen 60 to crush cut the web of material 14 by the pressure between circular blade 76 and platen 60 exerted against the web of material 14.

Figure 5:
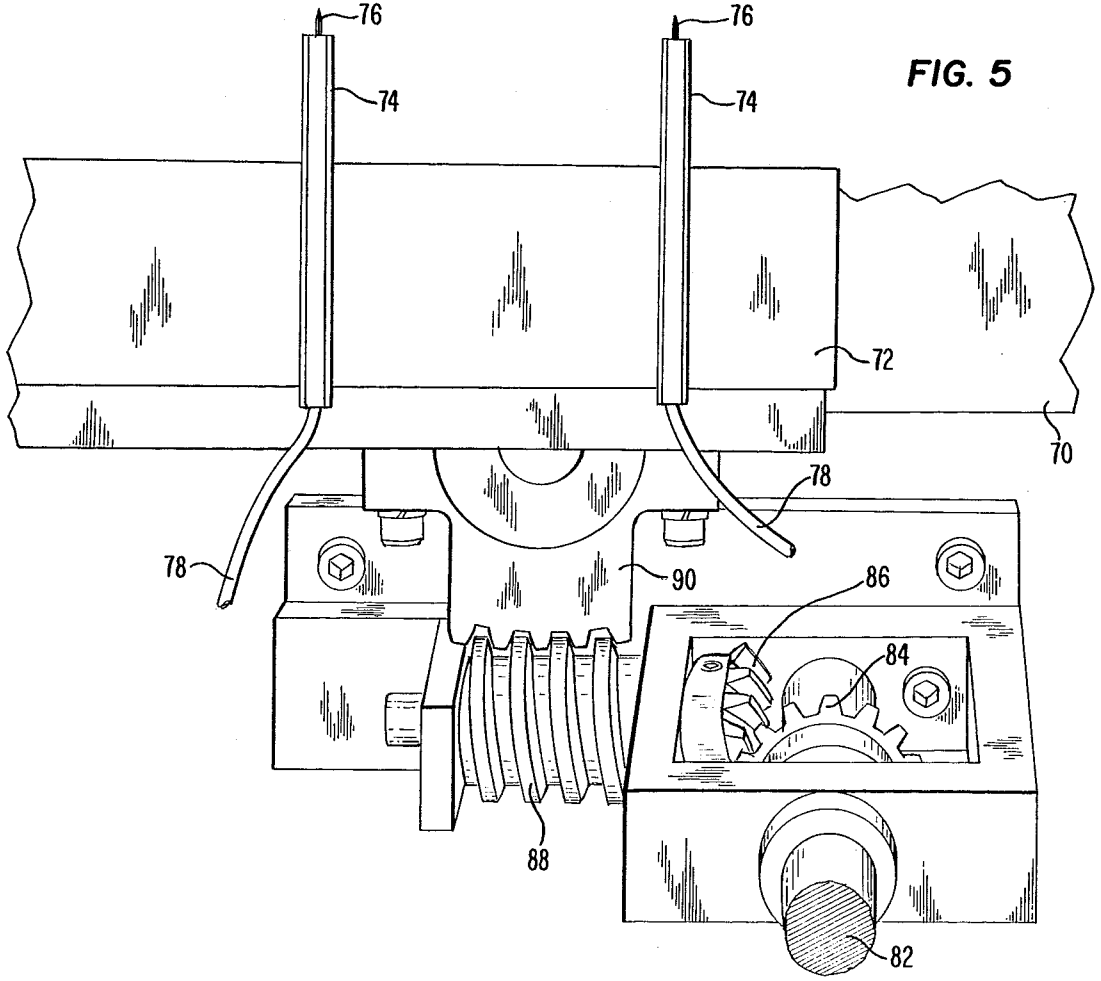
FIG. 5 is a front elevational view of preferred adjustment mechanism illustrated in FIG. 4.

The position of each group of circular blades 76 on each blade carrying block 72 can easily and accurately be adjusted in relation to platen 60 while the web of material 14 is being cut. Wheel 80 and shaft 82 are rotatably mounted to the bottom of horizontal metal track 70. A beveled gear 84 is mounted at its central axis perpendicular to the end of shaft 82 opposite to wheel 86. Beveled gear 84 intermeshes with another beveled gear 86 which is mounted on track 70 perpendicular to beveled gear 84. As shown in FIG. 5, beveled gear 82 is mounted at its central axis perpendicular to a worm gear shaft 88 with an axis of rotation parallel with the axis of rotation of platen roller 60. Worm gear shaft 88 and beveled gear 86 are rotatably mounted to the bottom of horizontal metal track 70. A piece of a circular worm gear 90 resembling a rack is mounted to each blade carrying block 72, and intermeshes with worm gear shaft 88. During the ribbon cutting operation, the machine operator can independently adjust the position of a group of blades 76 by turning wheel 80. Wheel 80 rotates shaft 82 which turns beveled gear 84, which in turn rotates beveled gear 86 to turn worm gear shaft 88 about its axis and move the piece of worm gear 90 resembling a rack and the blade carrying block 72 attached to the piece of worm gear 90. Turning wheel 80 thus moves a group of blades 76 on a blade carrying block 72, either to the left or to the right depending on the direction of rotation of wheel 80. Accordingly, the operator of the ribbon cutting apparatus of this invention 10 can make very fine adjustments in the position of each group of circular blades 76 to compensate for the stretching or shrinkage of the web of material 14 as it passes over platen 60 during the ribbon cutting operation.

It is preferred that more than one machine operator controls wheels 80 during the ribbon cutting operation. Thus, one operator can control the wheels on the right of the registration mark 42 and another operator can control the blades on the left of registration mark 42. Preferably, excess salvage from the end of the web of material 14 is removed by a vacuum suction tube 92. Accordingly, this invention allows the operators of the preferred ribbon cutting apparatus 10 to make quick and accurate independent adjustments in the position of groups of two or more blades during the cutting operation to quickly and accurately cut a web of material 14 with a plurality of patterns printed on the web into a large quantity of ribbons.

As may be apparent to those of ordinary skill in the art, various modifications can be made to the preferred apparatus of this invention including the utilization of different blades and blade carrying devices without departing from the spirit and scope of this invention.

I claim:

1. A ribbon cutting apparatus for cutting ribbons from a web of patterned material having at least one reference mark located in the patterned portion of said material, said apparatus comprising:

a frame;

a platen attached to said frame;

a plurality of cutter blades;

at least a first and second blade carrying means attached to said frame for carrying at least three cutter blades each such that the cutter blades carried by said first and second blade carrying means are separated by at least one ribbon width from each other; and, blade carrier positioning means for independently positioning said first and second blade carrying means on opposite sides of said reference mark as said web of patterned material travels over said platen, wherein said blade carrier positioning means independently positions said first and second blade carrying means to adjust for changes in said web of material.

2. The apparatus of claim 1 further comprising:

web registration detection means for detecting said reference mark; and, web translation means for moving said web in response to said web registration detection means.

3. The apparatus of claim 2 wherein said cutter blades comprise circular blades which crush cut said web of material against said platen.

4. The apparatus of claim 3 further comprising:

blade pressure means for applying pressure to said circular blades against said platen.

5. The apparatus of claim 4 wherein said platen comprises a roller.

6. The apparatus of claim 5 wherein said blade carrying means carries between three and nine circular blades.

7. The apparatus of claim 6 further comprising:

a track attached to said frame for supporting said blade carrying means.

8. The apparatus of claim 7 wherein said blade carrier positioning means comprises:

a rack having teeth therein attached to said blade carrying means;

a rack engagement gear, having teeth thereon for engaging the teeth of said rack, said rack engagement gear rotatably mounted to said track; and, driving means engaging said rack engagement gear for driving said rack engagement gear against said rack thereby causing said blade carrying means to move with respect to said web of material.

9. The apparatus of claim 8 wherein said web registration detection means includes a photocell for detecting the location of said reference mark.

10. The apparatus of claim 9 wherein said blade pressure means comprises a pneumatic cylinder carried by said blade carrier means for exerting pressure on said circular cutter blade in the direction of said platen roller.

11. The apparatus of claim 10 further comprising:

web spreading means for spreading said web of material positioned between said registration detection means and said blades.

12. The apparatus of claim 11 wherein said web spreading means comprises a bowed roller.

13. A method for cutting ribbons from a web of patterned material having at least one reference mark located in the patterned portion of said material, said method comprising the steps of:

running said web of material over a platen roller;

detecting said reference mark as it travels over said platen roller;

positioning a first blade carrying means having at least three circular blades thereon separated by a ribbon width from each other to one side of the traveling reference mark;

positioning a second blade carrying means having at least three circular blades thereon separated by a ribbon width from each other to the side of the traveling reference mark opposite from said first blade carrying means;

bringing said circular blades into contact with said web thereby cutting ribbons from said web on both sides of said traveling reference mark; and, independently repositioning said first and second blade carrying means to compensate for changes in the pattern of said web of material.

14. The method of claim 13 further comprising the step:

centering said web of material with respect to said platen roller when the traveling reference mark detected during said detecting steps moves out of alignment.

15. A method for cutting ribbons from a web of patterned material having at least one reference mark located in the patterned portion of said material, said method comprising the steps of:

running said web of material over a platen;

detecting said reference mark as it travels over said platen;

positioning a first group of blade carrying means including at least a first blade carrying means having at least three circular blades thereon separated by a ribbon width from each other to one side of said traveling reference mark;

positioning a second group of blade carrying means including at least a second blade carrying means having at least three circular blades thereon separated by a ribbon width from each other to the side of said traveling reference mark opposite from said first group of blade carrying means;

bringing said circular blades of said first and second groups of blade carrying means into contact with said web thereby cutting ribbons from said web on both sides of said traveling reference mark; and independently repositioning at least one of said blade carrying means to adjust for changes in the pattern of said web.

* * * * *